US006247837B1

(12) United States Patent
Wardberg

(10) Patent No.: US 6,247,837 B1
(45) Date of Patent: Jun. 19, 2001

(54) STIR STICK

(76) Inventor: Floyd Wardberg, 5301 - 1st Avenue, Regina, Saskathewan (CA), S4T 0A7

( * ) Notice: Subject to any disclaimer, the term of this patent is extended or adjusted under 35 U.S.C. 154(b) by 0 days.

(21) Appl. No.: 09/474,774

(22) Filed: Dec. 30, 1999

(51) Int. Cl.[7] ..... B01F 7/00
(52) U.S. Cl. ..... 366/129; 366/308; 366/343
(58) Field of Search ..... 366/129, 241, 366/279, 308, 309, 325.1, 325.92, 325.94, 326.1, 342, 343, 605; 416/72, 142, 240, 241 A; 99/348

(56) References Cited

U.S. PATENT DOCUMENTS

| | | | | |
|---|---|---|---|---|
| 427,963 | * | 5/1890 | Booz et al. . | |
| 579,055 | | 3/1897 | Gates et al. . | |
| 1,159,080 | * | 11/1915 | Poggensee . | |
| 2,092,353 | * | 9/1937 | Kyseth et al. . | |
| 2,161,508 | * | 6/1939 | Ensor et al. . | |
| 2,577,802 | * | 12/1951 | Payne . | |
| 3,011,768 | | 12/1961 | Clark . | |
| 3,166,303 | * | 1/1965 | Chapman . | |
| 3,223,389 | | 12/1965 | Simmonds . | |
| 3,326,533 | * | 6/1967 | Sturrup . | |
| 3,333,831 | * | 8/1967 | Chapman . | |
| 3,455,540 | | 7/1969 | Marcmann . | |
| 3,456,923 | * | 7/1969 | Zeuzem . | |
| 3,559,962 | | 2/1971 | Enssle et al. . | |
| 3,972,512 | * | 8/1976 | Grise et al. . | |
| 3,991,983 | * | 11/1976 | Drynan . | |
| 4,396,291 | | 8/1983 | Simmonds . | |
| 4,981,367 | | 1/1991 | Brazelton . | |
| 5,073,033 | | 12/1991 | Klepeis . | |
| 5,489,151 | | 2/1996 | Weber . | |
| 5,676,463 | * | 10/1997 | Larsen | 366/605 |
| 5,938,325 | * | 8/1999 | Edwards | 366/129 |
| 5,941,636 | | 8/1999 | Lu . | |

FOREIGN PATENT DOCUMENTS 960609 1/1975 (CA) .

OTHER PUBLICATIONS

Page from advertisement from Gardner Laboratory, Inc. entitled "Palo Stirrers Set the Standard" and showing a number of stirring mechanisms.

* cited by examiner

*Primary Examiner*—Charles E. Cooley
(74) *Attorney, Agent, or Firm*—Hunton & Williams

(57) ABSTRACT

There is provided a new and useful device for use in stirring liquid within a container which container has an opening with a smaller circumference than a circumference of a body of the container. The device comprises a cylindrical rod having a first end and a second end. There is provided a coupler at the first end that is constructed so as to rotationally couple the rod to a rotation source. There is further provided a split in the rod extending longitudinally from an approximate mid-point of the rod to the second end to form mixing blades. A portion of the mixing blades proximate to the second end are constructed so as to spread apart during the rotation of the device.

11 Claims, 2 Drawing Sheets

STIR STICK

FIELD OF THE INVENTION

This invention relates to a stir stick for use in stirring liquid within a container, such as wine within a carboy.

BACKGROUND OF THE INVENTION

The home wine making industry is ever growing in popularity. More and more people are learning the benefits of making their own wine, in terms of lower cost and the satisfaction of creating something unique and enjoyable. Whether it is done at home or at a commercial establishment, the basic steps in home winemaking are largely the same.

One step in the process is to stir the wine within the carboy after the fermentation stage. A vigorous stirring of the wine gets rid of solution $CO_2$ trapped within the wine in the carboy. Removing the gas greatly enhances the bouquet of the finished wine and is thus an important step in the process.

Unfortunately, despite the importance of this step, the most common method of stirring the wine is to simply use a long stick or a shaved down spoon and manually stirring the wine. This has proven to be a time consuming means of achieving the desired amount of stir. The small cross-section of the stick or the shaved down spoon may not always ensure that the liquid is completely stirred and, if stirred too aggressively, the spoon or stick is prone to break.

Other solutions to the problem have included the use of metal fins or the like attached to a slender rod whereby the fins mix the liquid when the rod is rotated. For example, the applicant is aware of a product marketed by PYI Innovative in association with the trade-mark FIZZ-X which incorporates this design. The effectiveness of this product is limited, however, due to its design since the fins may not separate from the rod in the proper orientation, thus requiring the user to stop rotating the rod, remove the device and adjust the fins. Further, the use of metal fins increases the risk of damage to the neck or the inside of the carboy during rotation of the rod. These limitations have been specifically addressed by the present applicant.

Other stirring devices known to the applicant do not integrate the necessary features to achieve the desired stirring of the liquid within the carboy or container. Reference may be had, for example, to Canadian Patent 960,609 of Aubry, Dispositif Pour Le Conditionnment et La Distribution De Produits, Comprenant Un Organe De Brassage, issued Jan. 7, 1975 and U.S. Pat. No. 3,326,533 of Sturrup, Nail Polish Stirrer, issued Jun. 20, 1967.

SUMMARY OF THE INVENTION

It is thus an object of the present invention to provide a stir stick for use in stirring liquid within a container, such as wine within a carboy that overcomes the deficiencies of the present devices.

In one aspect of the invention, there is provided a device for use in stirring liquid within a container which container has an opening with a smaller circumference than a circumference of a body of the container. The device comprises a cylindrical rod having a first end and a second end. There is provided a coupling means at the first end that is constructed so as to rotationally couple the rod to a rotation source. There is further provided a split in the rod extending longitudinally from an approximate mid-point of the rod to the second end to form mixing blades. A portion of the mixing blades proximate to the second end are constructed so as to spread apart during the rotation of the device.

In another aspect of the invention, the distal portions of the mixing blades are bent outwardly from an axis of the split to assist the spreading of the mixing blades during rotation of the device.

In another aspect of the invention, the rod has a right-circular cylindrical cross-section, and is made of resilient ultra-high molecular weight polyethylene.

BRIEF DESCRIPTION OF THE DRAWINGS

These and other advantages of the invention will become apparent upon reading the following detailed description and upon referring to the drawings in which.

Figure 1:
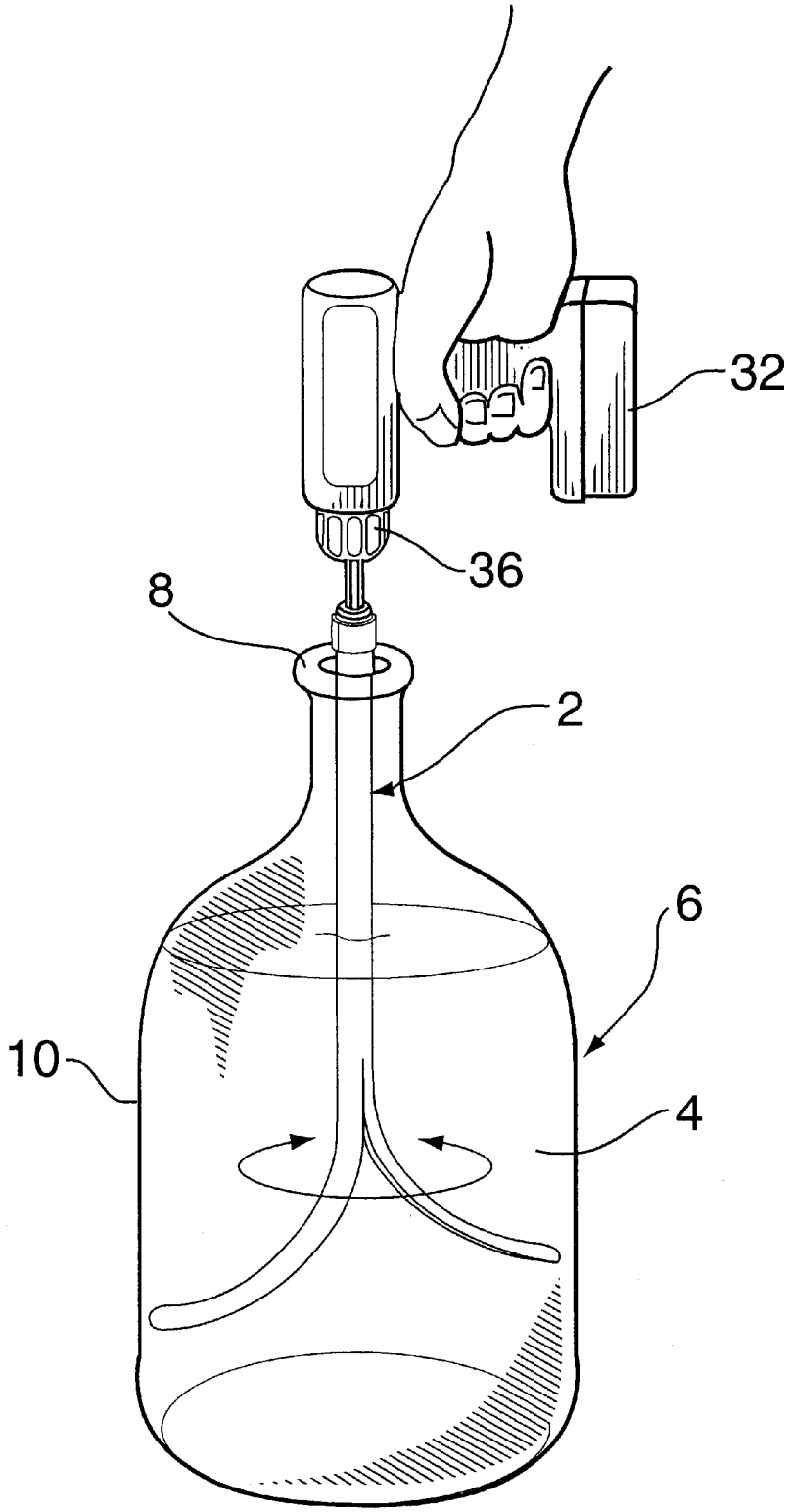
FIG. 1 is a perspective view of the stir stick of the present invention in use.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates a device 2 for use in stirring liquid 4 within a container 6. Although the device 2 is contemplated for use in stirring wine within a carboy, it will be apparent to those skilled in the art that the invention can be used for stirring any liquid within a container, such as paint within a can. For convenience, the liquid 4 and the container 6 will be referenced herein as wine and a carboy respectively.

The carboy 6 has an opening 8 which has a smaller circumference than the body 10 of the carboy 6. As will be described in greater detail below, this leads to certain design criteria for the device 2.

Figure 2:
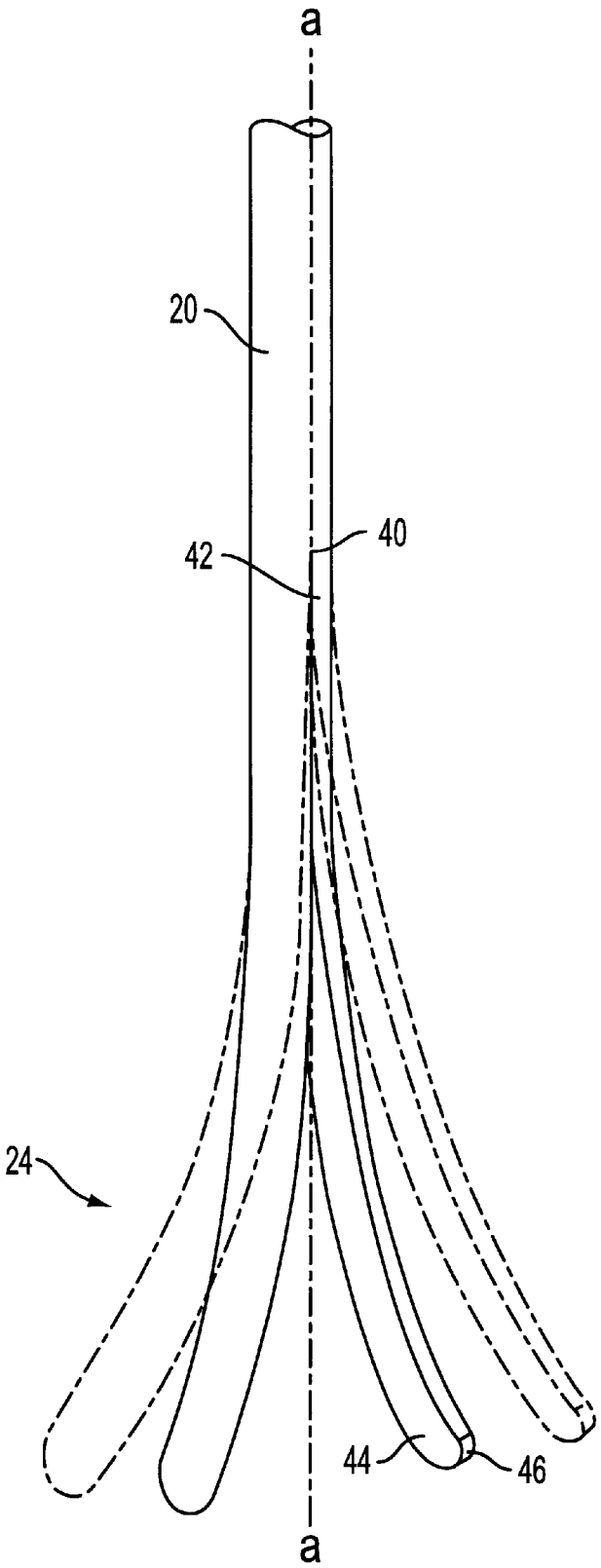
FIG. 2 is a perspective view of the second end of the stir stick.

As shown in FIG. 2, the device 2 comprises a rod 20 which has a first end 22 and a second end 24 and defines an axis that extends between the first end and the second end. The rod 20 preferably has a right circular cylindrical shape, although other cross-sections of rods can be used. Such other cross-sections (not shown) may have to be modified somewhat, particularly at the second end 24 in order to achieve the optimal stirring effect from the device 2. The rod 20 as illustrated is three-quarters of an inch (¾") in diameter and approximately twenty-four (24) inches in length, from the first end 22 to the second end 24. Other diameters of rod, including but not limited to one-half inch (½") or five-eighths of an inch (⅝") may also be used.

Figure 3:
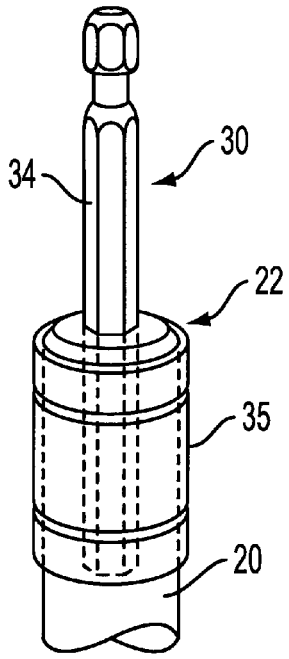
FIG. 3 is a perspective view of the first end of the stir stick.

At the first end 22 of the device 2, as best seen in FIG. 3, there is a coupling means 30 which is constructed so as to allow the rod 20 to be rotationally coupled to a rotation source, such as a conventional portable drill 32 as shown in FIG. 1. The coupling means 30 preferably comprises a shaft 34, typically hexagonal in cross-section, embedded partly within the rod 20 at the first end 22. A one-quarter (¼) inch stainless steel shaft, approximately three (3) inches in length and embedded one and one quarter (1¼) inches into the first end 22 has been found to be an acceptable configuration for the coupling means 30, although other diameters or lengths of shaft may be used to accommodate a larger or smaller diameter rod 20. The protruding portion of the shaft 34 couples with the chuck 36 (shown in FIG. 1) of the drill 32 in order to transfer rotation of the drill 32 to the rod 20, in use. An outer sleeve 35 of stainless steel or the like may be positioned and crimped around the portion of the rod 20 into which the shaft 34 is partly embedded to provide additional holding strength for the shaft 34 within the rod 20.

As shown in FIG. 2, a split 40 is provided in the rod 20. The split 40 runs longitudinally along the axis from an approximate mid-point 42 of the rod 40 to the second end 24. Thus, at the second end 24, the split 40 in the rod 20 diverges to form mixing blades 44. A portion of each mixing blade proximate the mid-point 42 are substantially parallel and located in a first position that is substantially adjacent the axis prior to being rotated by the rotation source 32 (as shown by the solid lines in FIG. 2). These portions are then located in a second spread apart position when rotated (as shown by the dashed lines in FIG. 2) and return to the first position upon cessation of the rotational force. The mixing blades 44 are shaped and contoured so as to form a curved leading edge 46 in order to assist the blades 44 to pass through and thoroughly stir the wine 4 within the carboy 6. In this manner, the cross-section of the blades 44 may approximate an airfoil. This construction allows the blades 44 to move to a position approaching 90 degrees to the axis a—a, or approaching a horizontal plane, parallel to the bottom surface of the carboy 6. In this manner, as will be discussed below, a lifting action and convection movement is imparted to the wine 4 during operation of the device 2. The rod 20 is made of a durable food grade plastic, preferably a resilient ultra-high molecular weight polyethylene. Other possible materials include polypropylene, polycarbonate and NYLON™. With this material, the distalends of blades 44 can be bent outwardly from the axis a-a of the split 40, as seen in the solid lines shown in FIG. 2. This bending acts as a memory in the resilient rod 20 such that if the blades 44 are pressed together under a direct force, those blades 44 will tend to return to that bent position when such force is removed. In a similar fashion, the blades 44 are free to spread apart (as shown in dashed lines in FIG. 2) when a force is exerted upon them but the blades 44 will tend to return to that bent orientation once that force is removed.

In use, therefore, the device 2 may be inserted into the carboy 6 by pressing the blades 44 together to allow the second end 24 to pass through the opening 8. Once through the opening 8 and within the larger circumference of the body 10, the blades 44 will tend to return to their outwardly bent orientation.

The shaft 34 is then inserted into the chuck 36 of the drill 32, while the drill 32 is off. It will be appreciated by those skilled in the art that the device 2 can be attached to the drill 32 before the second end 24 is inserted into the carboy 6, if preferred.

Once the second end 24 is situated within the carboy 6 to a sufficient depth within the wine 4, the drill 32 can be actuated, thus imparting the rotation to the device 2. The centrifugal force on the second end 24 which naturally results from the rotation of the rod 20 will urge the blades 44 outwardly to the approximate orientation shown in FIG. 1 and in phantom in FIG. 2. The blades 44 can and often will move to the extreme outside within the carboy 6, assisting the lifting of the wine 4 from the bottom of the carboy 6. In this manner, there is achieved a more complete stirring of the wine 4 within the carboy 6 than would be achieved by rigid blades. By providing a split 40 approximately one-half the length of the rod 20 (i.e. approximately twelve (12) inches in length), the resilient blades 44 are permitted to spread apart to achieve an efficient stir of the wine 4, without a significant risk of impacting the inside surface of the carboy 6. Thus the risk of chipping or breaking the glass carboy is minimized.

Once the wine 4 has been sufficiently stirred (which will be determined by conventional wine-making techniques), the drill 32 is turned off. Once the rod 20 has stopped rotating, the device 2 can be removed from the carboy 6 be simply pulling the rod 20 up through the opening 8. The resiliency and shape of the blades 44 will allow them to deform to fit through the opening 8 and once clear of the opening 8, the blades 44 will return to their outwardly bent orientation. The device 2 can then be cleaned and is ready for another use. The design, construction and material of the device 2 allow it to be used repeatedly without any significant wear on the device 2 and particularly on the mixing blades 44.

Thus, it is apparent that there has been provided in accordance with the invention a stir stick that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. A device for use in stirring liquid within a container having an opening with a smaller circumference than a circumference of a body of said container, said device comprising:

a cylindrical rod having a first end and a second end and an axis extending between said first end and said second end;

a shaft at said first end constructed so as to rationally couple said rod to a rotation source; and a split in at said rod extending longitudinally along said axis from an approximate mid-point of said rod to said second end to form mixing blades, wherein said rod comprises a resilient material such that a portion of each said mixing blade proximate to said mid-point are substantially parallel and located in a first position that is substantially adjacent to said axis prior to being rotated by said rotation source, said portions are located in a second spread apart position when rotating under the influence of, at least, a rotational force imparted to said shaft by said rotation source, and return to said first position upon cessation of said rotational force.

2. The device of claim 1 wherein distal portions of said mixing blades are bent outwardly from the axis to assist spreading when rotating.

3. The device of claim 2 wherein said distal portions are constructed so as to be selectively pressed together to pass through said opening in said container and released to return to said outwardly bent orientation.

4. The device of claim 1 wherein said rod has a right circular cylindrical cross-section.

5. The device of claim 1 wherein said resilient material is a resilient ultra-high molecular weight polyethylene.

6. The device of claim 1, wherein said shaft is hexagonal shaped and is constructed so as to fit within a chuck of a drill.

7. The device of claim 1 wherein distal ends of said mixing blades have a curved leading edge.

8. The device of claim 1 wherein the cross-section of said mixing blades approximates an airfoil.

9. A device for use in stirring liquid within a container, said container having an opening with a smaller circumference than a circumference of a body of said container, said device comprising:

a right-circular cylindrical rod said rod having a first end and a second end and an axis extending between said first end and said second end;

a hexagonal shaped shaft at said first end constructed so as to rotationally couple said rod to a rotation source; and a split in said rod extending longitudinally along said axis from an approximate mid-point portion of said rod to said second end to form mixing blades, wherein said rod comprises resilient plastic such that a portion of each said mixing blade proximate to said mid-point are substantially parallel and located in a first position that is substantially adjacent to said axis prior to being rotated by said rotation source, said portions are located in a second spread apart position when rotating under the influence of, at least, a rotational force imparted to said hexagonal shaped shaft by said rotation source, and return to said first position upon cessation of said rotational force; and wherein distal portions of said mixing blades may be selectively pressed together to pass through said opening in said container and released to return to an outwardly bent orientation within said body of said container.

10. A method of mixing liquid within a container having an opening with a circumference smaller than a circumference of a body of said container, said method using a device comprising a right-circular cylindrical rod, constructed of a resilient plastic, said rod having a first end and a second end, a hexagonal shaped shaft at said first end constructed so as to rotationally couple said rod to a rotation source and a split in said rod extending longitudinally from an approximate mid-point of said rod to said second end to form mixing blades, wherein a portion of said mixing blades proximate to said second end are bent outwardly from an axis of said split to assist spreading during rotation, said method comprising the steps of:

pressing together said mixing blades to allow said second end to pass through said opening;

allowing said mixing blades to return to the outwardly bent orientation, within said body of said container;

attaching said device to a rotation source;

rotating said device, wherein said mixing blades are spread apart due at least in part, to a rotational force imparted by said rotation source on said hexagonal shaped shaft so as to mix said liquid within said container; and stopping the rotation and removing said device by pulling said mixing blades through said opening when said liquid is sufficiently mixed.

11. The method of claim 10 wherin said liquid is wine and said container is a carboy.

* * * * *